US010858821B2

(12) United States Patent
Ross

(10) Patent No.: US 10,858,821 B2
(45) Date of Patent: Dec. 8, 2020

(54) BAMBOO POLE CONNECTORS FOR BUILDING CONSTRUCTION

(71) Applicant: Timothy Jack Ross, Albuquerque, NM (US)

(72) Inventor: Timothy Jack Ross, Albuquerque, NM (US)

( * ) Notice: Subject to any disclaimer, the term of this patent is extended or adjusted under 35 U.S.C. 154(b) by 578 days.

(21) Appl. No.: 15/506,905

(22) PCT Filed: Sep. 25, 2015

(86) PCT No.: PCT/US2015/052264
§ 371 (c)(1),
(2) Date: Feb. 27, 2017

(87) PCT Pub. No.: WO2016/049478
PCT Pub. Date: Mar. 31, 2016

(65) Prior Publication Data

US 2017/0241127 A1 Aug. 24, 2017

Related U.S. Application Data

(60) Provisional application No. 62/056,177, filed on Sep. 26, 2014.

(51) Int. Cl.
*E04B 1/26* (2006.01)
*E04B 1/41* (2006.01)

(52) U.S. Cl.
CPC ..... *E04B 1/2604* (2013.01); *E04B 1/40* (2013.01); *E04B 2001/266* (2013.01); *E04B 2001/268* (2013.01); *E04B 2001/2668* (2013.01); *E04B 2001/2684* (2013.01); *Y10T 403/5766* (2015.01)

(58) Field of Classification Search
CPC . E04B 1/19; E04B 1/1903; E04B 1/26; E04B 1/2604; E04B 1/40;
(Continued)

(56) References Cited

U.S. PATENT DOCUMENTS 2,820,655 A * 1/1958 Hileman ..... F16B 7/20 403/349
3,021,159 A * 2/1962 Back ..... A47B 47/0008 403/191
(Continued)

FOREIGN PATENT DOCUMENTS

WO WO-8701150 A1 * 2/1987 ..... E04B 1/19

OTHER PUBLICATIONS

United States International Searching Authority; International Search Report & Written Opinion for PCT/US2015/052264 dated Dec. 22, 2015; 17 pages; Alexandria, VA; US.

*Primary Examiner* — Josh Skroupa
(74) *Attorney, Agent, or Firm* — Peacock Law P.C.; Justin R. Muehlmeyer

(57) ABSTRACT

A construction system for connecting bamboo segments or poles together, where the segments or poles have non-uniform diameters. The system includes elbow connectors, sleeve connectors, T-shaped connectors and six cavity connectors. Also, part of the connectors include connector segments including an opening defined by a plurality of opposingly located arms separated by one or more channels, and at least one hoop-compression clamp adapted to be positioned around the arms. The arms and hoop-compression clamp cooperate to compress the arms against the bamboo segment to sec1n-e bamboo segment within the connector opening.

17 Claims, 6 Drawing Sheets

(58) Field of Classification Search
CPC ..... E04B 2001/2628; E04B 2001/266; E04B 2001/2668; E04B 2001/268; E04B 2001/2684; F16B 7/0426; F16B 7/048; F16B 7/20; Y10T 403/34; Y10T 403/341; Y10T 403/342; Y10T 403/347; Y10T 403/42; Y10T 403/44; Y10T 403/53; Y10T 403/535; Y10T 403/5761; Y10T 403/5766
USPC ..... 403/169, 170, 171, 176, 205, 217, 289, 403/290, 309, 310; 52/653.2, 655.1
See application file for complete search history.

(56) References Cited

U.S. PATENT DOCUMENTS 3,424,178 A * 1/1969 Yazaki ..... A01G 9/16 135/157
3,792,882 A * 2/1974 Varichon ..... E04B 1/19 403/171
3,881,830 A 6/1975 Kato et al.
4,161,375 A * 7/1979 Murphy ..... F16B 7/0446 403/169
5,526,614 A * 6/1996 Huang ..... E04B 1/24 135/909
6,371,432 B1 4/2002 Tsappi
6,843,516 B2 * 1/2005 Bishop ..... F16L 21/06 277/605
7,246,826 B2 * 7/2007 Ignaczak ..... F16L 21/065 285/382
7,325,776 B2 * 2/2008 Shibuya ..... F16L 3/1016 403/310
10,036,155 B2 * 7/2018 Carless ..... E04B 1/19
2004/0007875 A1 1/2004 Bishop et al.
2006/0071471 A1 4/2006 Ignaczak et al.
2008/0098690 A1 5/2008 Wang
2010/0083605 A1 4/2010 Wallner
2014/0186096 A1 7/2014 Collin
2014/0308067 A1 10/2014 Boudeman

* cited by examiner

BAMBOO POLE CONNECTORS FOR BUILDING CONSTRUCTION

RELATED APPLICATIONS

This application claims the benefit of U.S. Provisional Application No. 62/056,177 filed Sep. 26, 2014 and herein incorporated by reference.

STATEMENT REGARDING FEDERALLY SPONSORED RESEARCH & DEVELOPMENT

Not applicable.

INCORPORATION BY REFERENCE OF MATERIAL SUBMITTED ON A COMPACT DISC

Not applicable.

BACKGROUND OF THE INVENTION

Bamboo poles or segments have been long used as building materials. In addition to simply fastening the poles together with rope or twine wrappings, the segments have also been connected by bolts or wire. These prior art connections do not resist bending moments at the joints and may cause weaknesses in the bamboo itself because of using perforations. Additionally, these prior art connections are not useful over the long life of a building.

BRIEF SUMMARY OF THE INVENTION

In one aspect, the present invention comprises a natural resource, bamboo, that in combination with a plurality of connectors form a building system that allows the bamboo segments to function as the load carrying members of buildings with a plurality of floors, including single-story buildings.

In other embodiments, the present invention provides a building system comprised of connectors whereby buildings are built that have superior strength and stiffness characteristics to conventional wood buildings, as well as to some smaller concrete and steel buildings.

In yet other embodiments, the present invention utilizes bamboo segments and connectors that create a building system that significantly reduces the carbon footprint, as well as being much less expensive as compared to conventional building materials.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

In the drawings, which are not necessarily drawn to scale, like numerals may describe substantially similar components throughout the several views. Like numerals having different letter suffixes may represent different instances of substantially similar components. The drawings illustrate generally, by way of example, but not by way of limitation, a detailed description of certain embodiments discussed in the present document.

DETAILED DESCRIPTION OF THE INVENTION

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a representative basis for teaching one skilled in the art to variously employ the present invention in virtually any appropriately detailed method, structure or system. Further, the terms and phrases used herein are not intended to be limiting, but rather to provide an understandable description of the invention.

The connectors of the present invention accept the natural, non-uniform geometry of a bamboo pole or segment, as well as other natural materials, which is cylindrical, and they provide rigidity and bending moment transfer without the need for screws, bolts, nails, or other attachment devices.

Figure 1A:
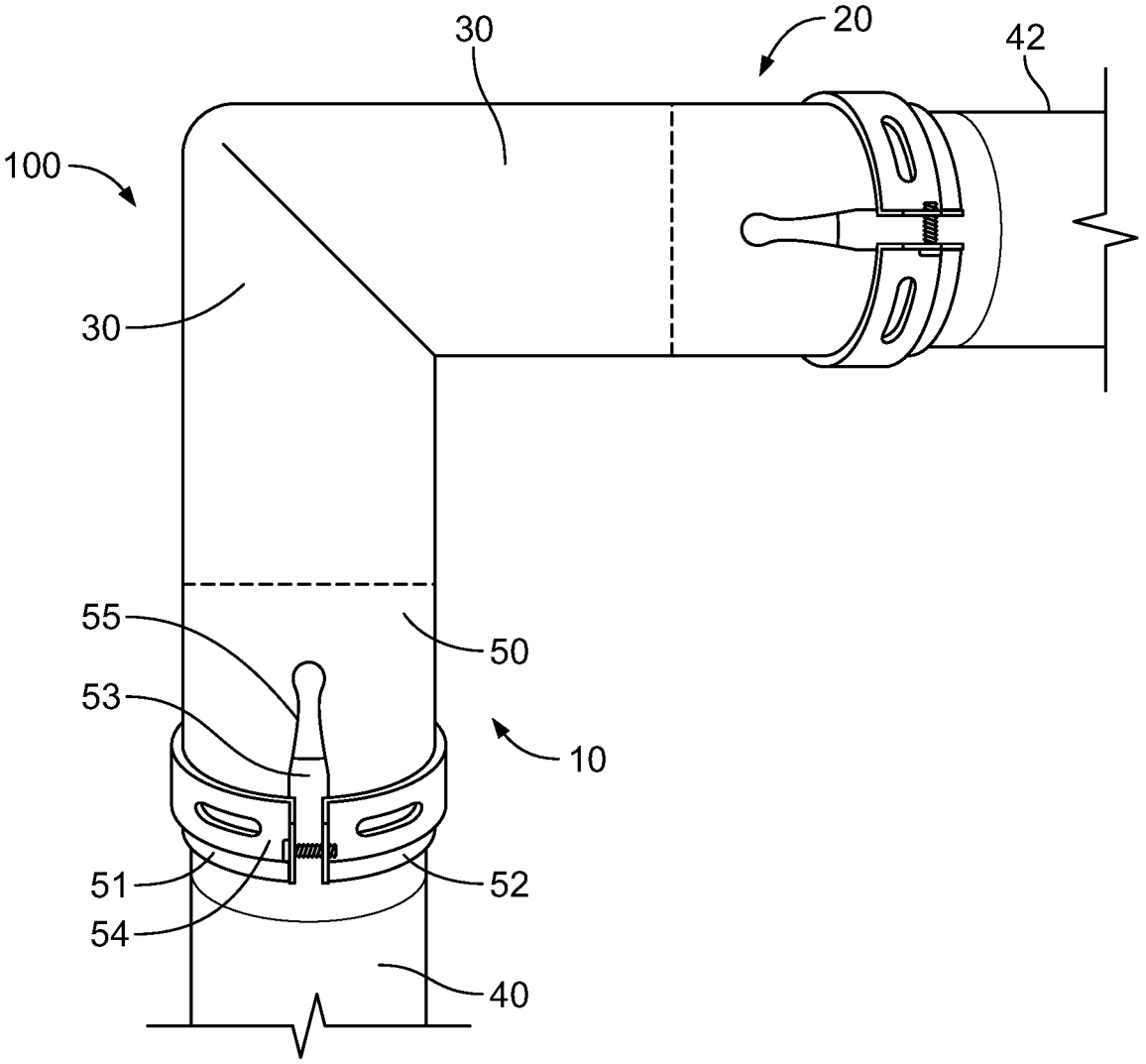
FIG. 1A illustrates a corner or right angle connector of an embodiment of the present invention.

Moreover, the present invention may be used with building materials having non-uniform diameters from one end to the other. Attachment of the material is secured by the use of clamping segments 10 and 20 as shown in FIG. 1A. As will be described in detail below, a clamping segment is a basic component of the various connectors that may be used with the embodiments of the present invention.

In a preferred embodiment, which is described for use with a bamboo pole for illustrative purposes only, a clamping segment uses a combination of hoop compression and/or internal friction to secure a bamboo segment to a connector as described in detail below.

FIG. 1A illustrates a 90-degree, or elbow, connector 100 that secures and connects bamboo segments 40 and 42 together at a right angle. The basic components of connector 100 are connector segments 10 and 20 which are joined together at a 90-degree angle by body 30. To secure a bamboo segment to the connector, a connector segment includes a base 50, spaced apart flanges or arms 51 and 52 separated by channel 53 which is part of main opening 55. In use, opening 55 created by arms 51 and 52 is sized to accommodate a range of the bamboo segments or poles to be used. In a preferred, each connector is configured to accommodate segments or poles that vary by ½ inch in diameter. Once a bamboo segment is inserted into opening 55, it becomes wedged in place by a friction fit. Opening 55 may be tapered from broad, at the distal end, to narrow at the proximal end to promote a friction fit.

Clamp 54 is a hoop-compression clamp that further binds the segment to the connector as result of urging arms 51 and 52 against bamboo segment 40. The use of at least one channel or slit 53 permits the arms to contract inwardly to create a rigid connection. In addition, other channels or slits may be provided as well. Similarly constructed connector segment 20 secures bamboo segment 42 in place.

Figure 1B:
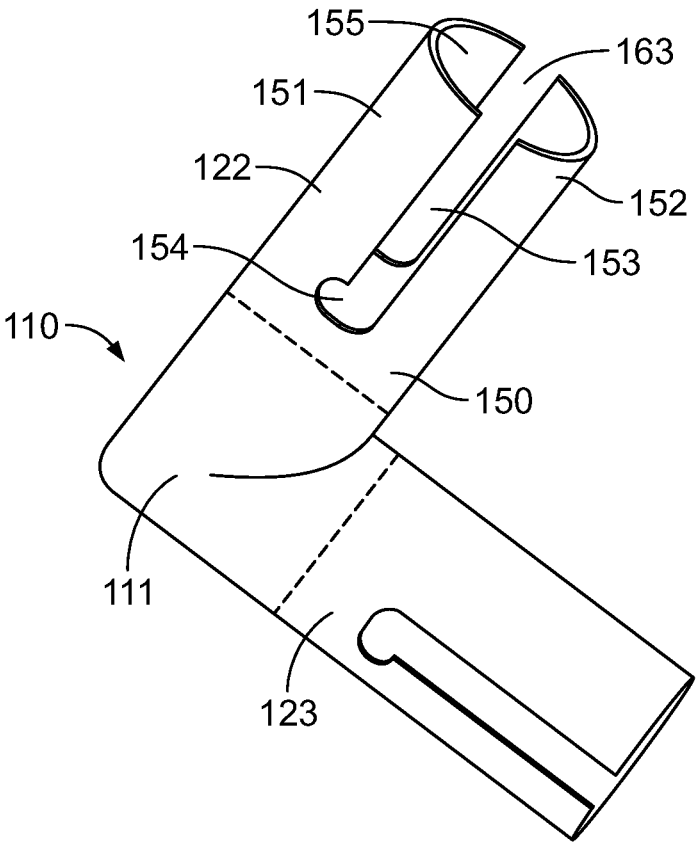
FIG. 1B illustrates another corner or right angle connector of an embodiment of the present invention, which represents the intersection of one column and one beam.

FIG. 1B illustrates another 90-degree or elbow connector 110 that secures and connects bamboo segments. The basic components of connector 110 are connector segments 122 and 123 which are joined together at 90-degrees by body 111. To secure a bamboo segment to the connector, a connector segment includes a base 150 and spaced apart flanges or arms 151 and 152. The flanges or arms are separated by one or more channels or slits 153 and 163 which are part of opening 155. Channel or slit 153 has a scalloped section 154 to further promote the flexing of the arms or flanges.

In use, a bamboo segment or pole is inserted into opening 155 until it becomes wedged in place by a friction fit. Opening 155 may be tapered from broad to narrow, as described above, to promote a friction fit. A hoop-compression clamp that further binds the segment to the connector as result of urging arms 151 and 152 against a bamboo segment may be used. The use of at least one channel or slit permits the arms to contract either inwardly or outwardly. In addition, other channels or slits may be provided as well. Similarly constructed connector segment 123 secures a bamboo segment in place.

Figure 2:
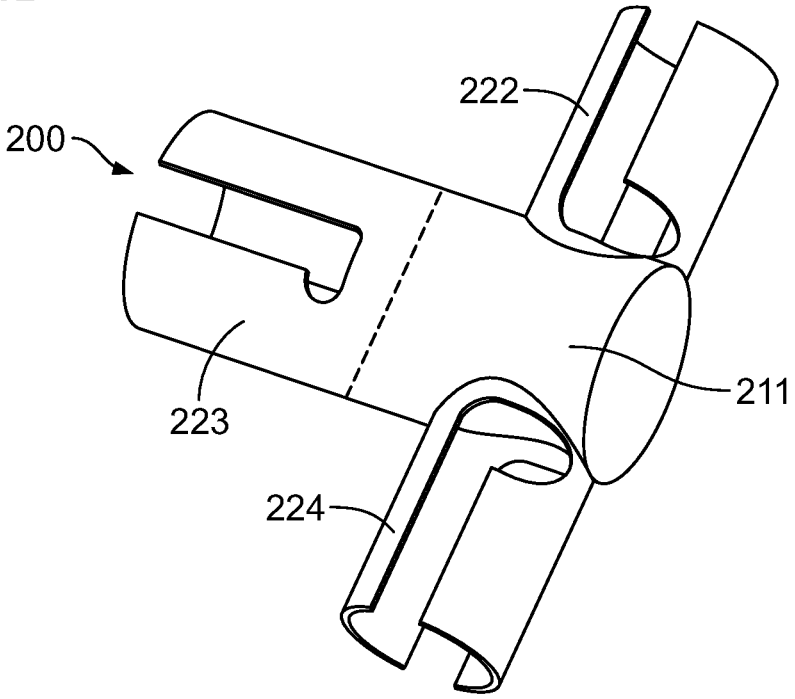
FIG. 2 illustrates a T-shaped connector of an embodiment of the present invention, which represents the intersection of one column and two collinear beams.

FIG. 2 illustrates a T-shaped connector 200 of an embodiment of the present invention. As shown, it is comprised of body 211 that interconnects three connector segments 222-224. In other embodiments of the present invention, the diameter of connector segment 223 is larger than the diameter of the other connectors segments to accommodate larger structural members if needed. Alternately, the diameters may be the same. A bamboo segment is secured to a connector by a friction fit and/or hoop-compression as described above.

Figure 3:
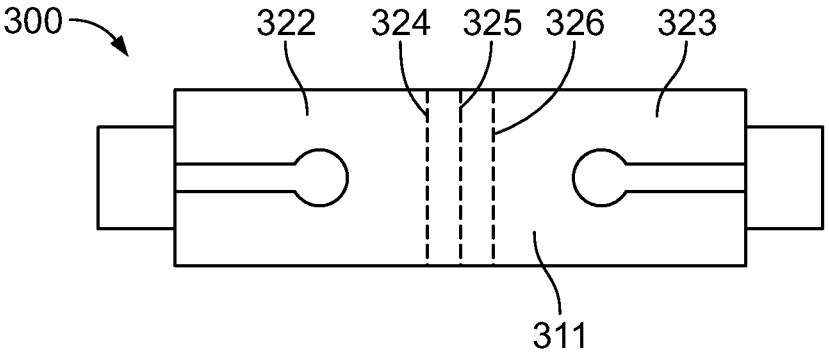
FIG. 3 illustrates a sleeve connector of an embodiment of the present invention, which represents a connection of two collinear beams.

FIG. 3 illustrates a sleeve connector 300 of an embodiment of the present invention. As shown, it is comprised of body 311 that interconnects connector segments 322-323 in a collinear arrangement. Bamboo segments 350 and 352 may be secured to the connectors by a friction fit and/or hoop-compression as described above.

Figure 4:
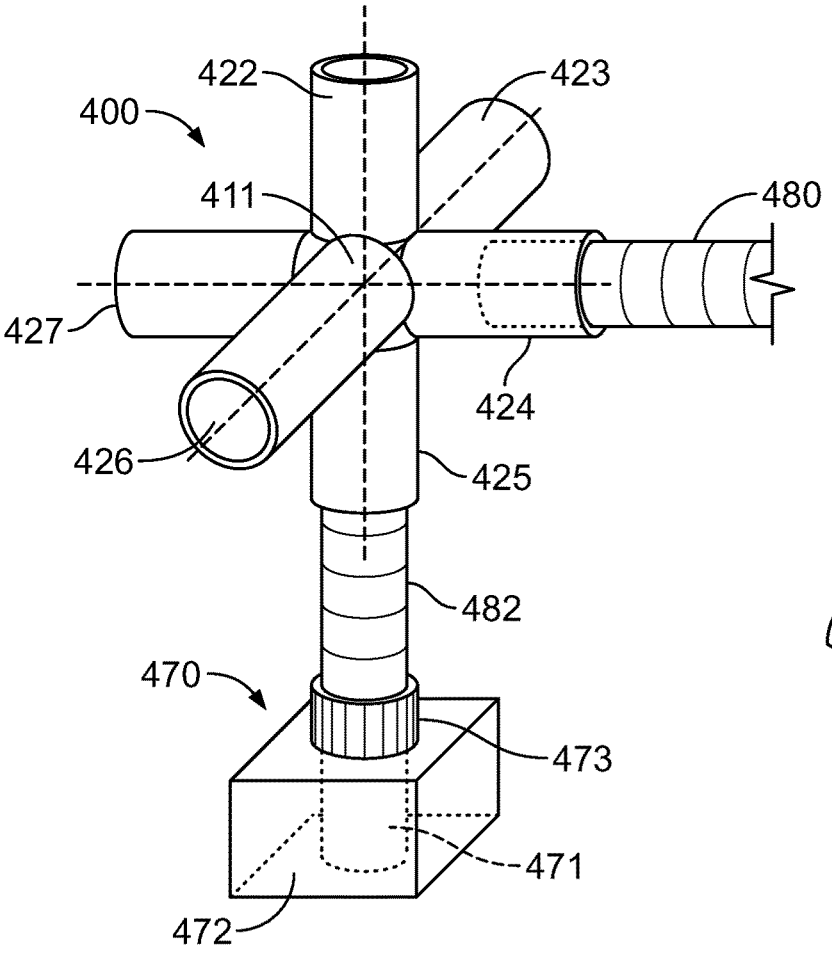
FIG. 4 illustrates a load bearing interior connector of an embodiment of the present invention in combination with a foundation connector to form a load bearing system. For one embodiment of the present invention, the load bearing interior connector represents the connection of two collinear column segments and four collinear beams in each of two orthogonal directions.

FIG. 4 illustrates a three dimensional load bearing interior system provided by an embodiment of the present invention. As shown, the system includes load bearing interior connector 400 comprised of body 411 that interconnects six connector segments 422-427 at right angles, with for orthogonally oriented beams intersecting with two collinear columns. This embodiment of the present invention may be used to provide load bearing interior support for external cladding or walls as well as interior cladding, ceilings, roofs, walls, panels and floors.

Bamboo segments 480 and 482 may be secured to the connectors by a friction fit and/or hoop-compression as described above. In other embodiments of the present invention, the diameter of a particular connector segment may be larger than the diameter of the other connectors segments to accommodate larger structural members if needed.

Also provided is foundation anchor connector 470 that has a body 471 adapted to be secured in place in a concrete foundation 472 during pouring. A connector segment 473 of a construction described above and shown in FIG. 5A, secures a bamboo segment.

Figure 5B:
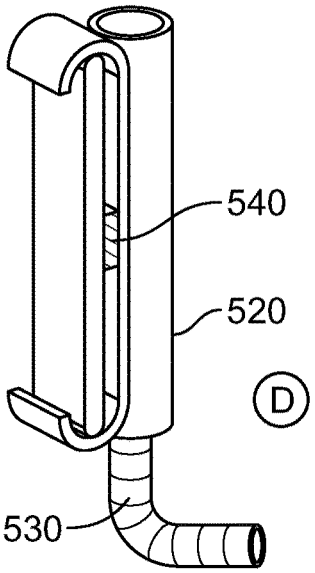
FIG. 5B illustrates an anchor holder provided by an embodiment of the present invention.
Figure 5A:
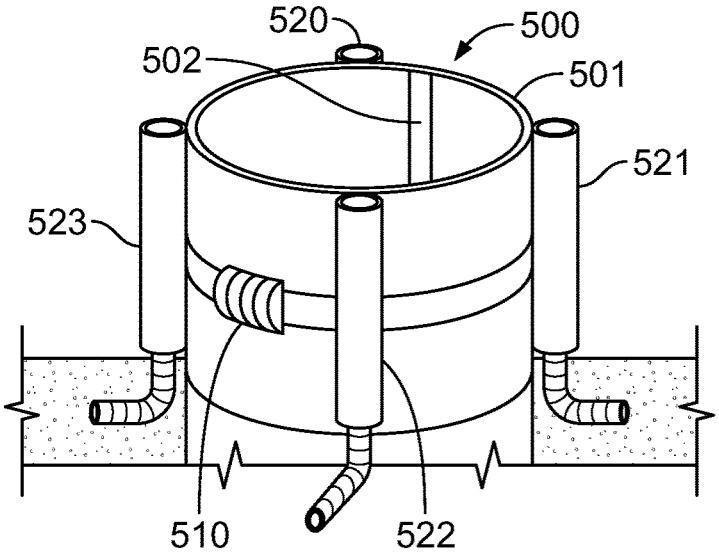
FIG. 5A illustrates another foundation connector provided by an embodiment of the present invention.
Figure 6:
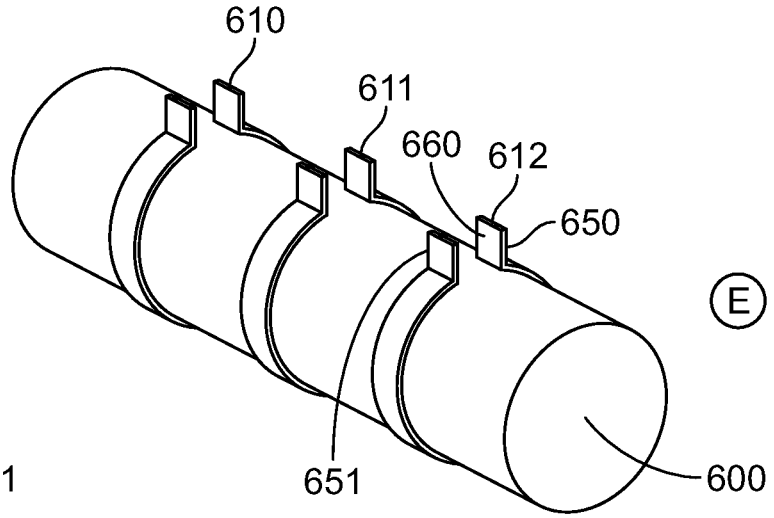
FIG. 6 illustrates a beam or column system provided by an embodiment of the present invention having a wall or floor attachment connector for use with a beam and/or column and the clamps shown in FIGS. 7-9.

FIG. 5A illustrates another foundation or load bearing connector system provided by an embodiment of the present invention. As shown, base connector 500 includes a sleeve 501 having an expansion or contraction slot 502 that accommodates bamboo segments having various diameters. As shown, sleeve 501 wraps around a bamboo segment. As described above, a bamboo segment may be secured inside the opening created by sleeve 501 by a friction fit and/or hoop-compression created by clamp 510, which may be a tension clamp.

As shown in FIGS. 5A and 5B, a plurality of anchor holders 520-523 may be provided. As shown, each anchor holder may be adapted to receive reinforcing rod 530 such as rebar so as to permit securing base connector 500 in concrete. In addition, each holder may have an opening 540 to permit the passage of tension clamp 510.

Figure 7:
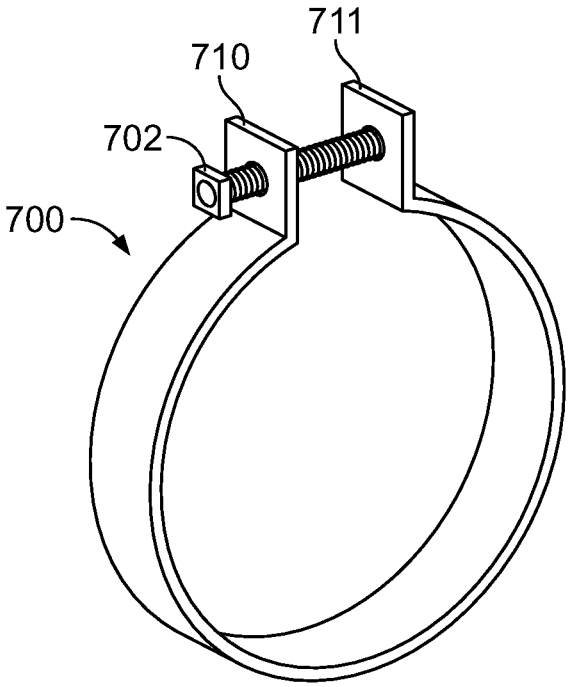
FIG. 7 illustrates a clamp that may be used with the present invention.
Figure 8:
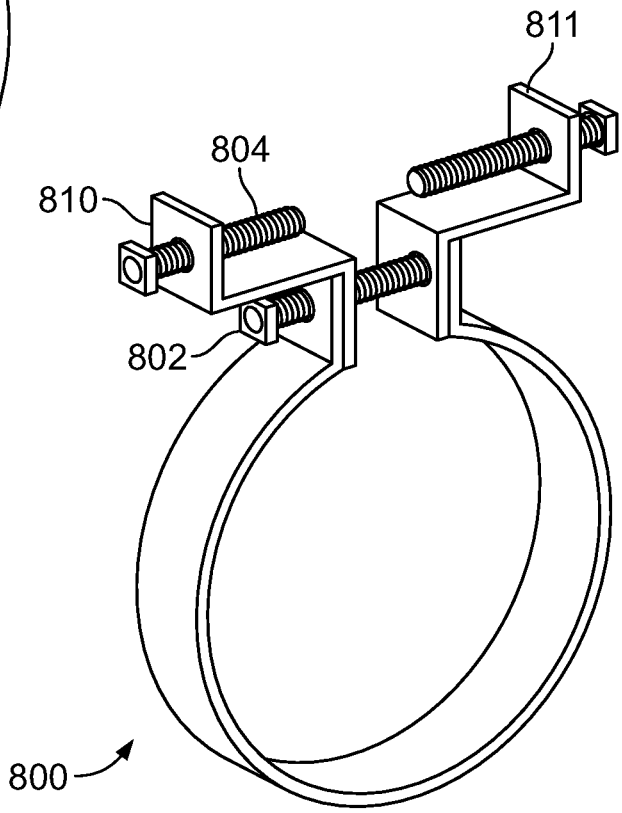
FIG. 8 illustrates another clamp that may be used with the present invention.

FIGS. 6-10 illustrate a beam or column system that may be used to form panels of bamboo segments or other building materials that may be used to create walls, floors and ceilings. As shown, bamboo segment 600 has a series of panel clamps located on the outer surface of a structural bamboo segment which are postionable on the segment. As shown, panel clamps 610-612 are configured to have spaced apart flanges that form a channel in which a sheet of building material may seat. Specifically, as shown for panel clamp 612, opposingly located arms or flanges 650-651 create channel 660. This design may be employed with the other panel clamps as well, as shown in FIGS. 7 and 8.

FIG. 7 illustrates another panel clamp 700 that may be used with the present invention. Fastener 702 secures the panel clamp to a bamboo segment while arms 710 and 711 act as plugs that reside inside a bamboo segment to hold the segment in place. Alternately, arms 710 and 711 may clamp the outside surface of a thin panel to secure the panel in place.

FIG. 8 illustrates another panel clamp 800 that may be used with the present invention. Fastener 802 secures the panel clamp to a bamboo segment while a second fastener 804 works with arms 810 and 811 to clamp a flat panel such as drywall or plywood in place.

Figure 9:
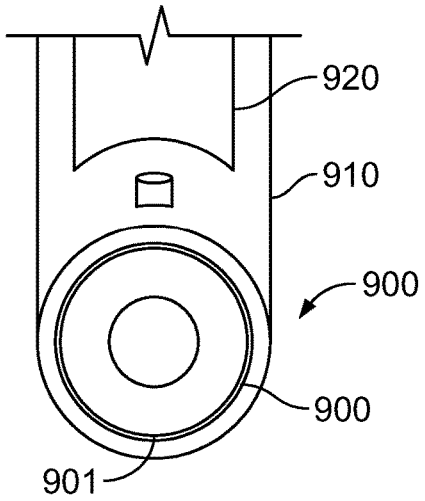
FIG. 9 illustrates another clamp that may be used with the present invention to connect a floor or wall to a beam or column.

FIG. 9 illustrates yet another panel clamp 900 that may be used to secure to a bamboo segment 901 to create panels. As shown, panel clamp 900 is first affixed to a horizontal support or pole 901 and then, a connector segment 910 of a construction that was described above, forms a friction fit with vertical segment or wall 920. An optional clamp, not shown, may also be used to provide a compression fit around the pole or segment 901.

Figure 10:
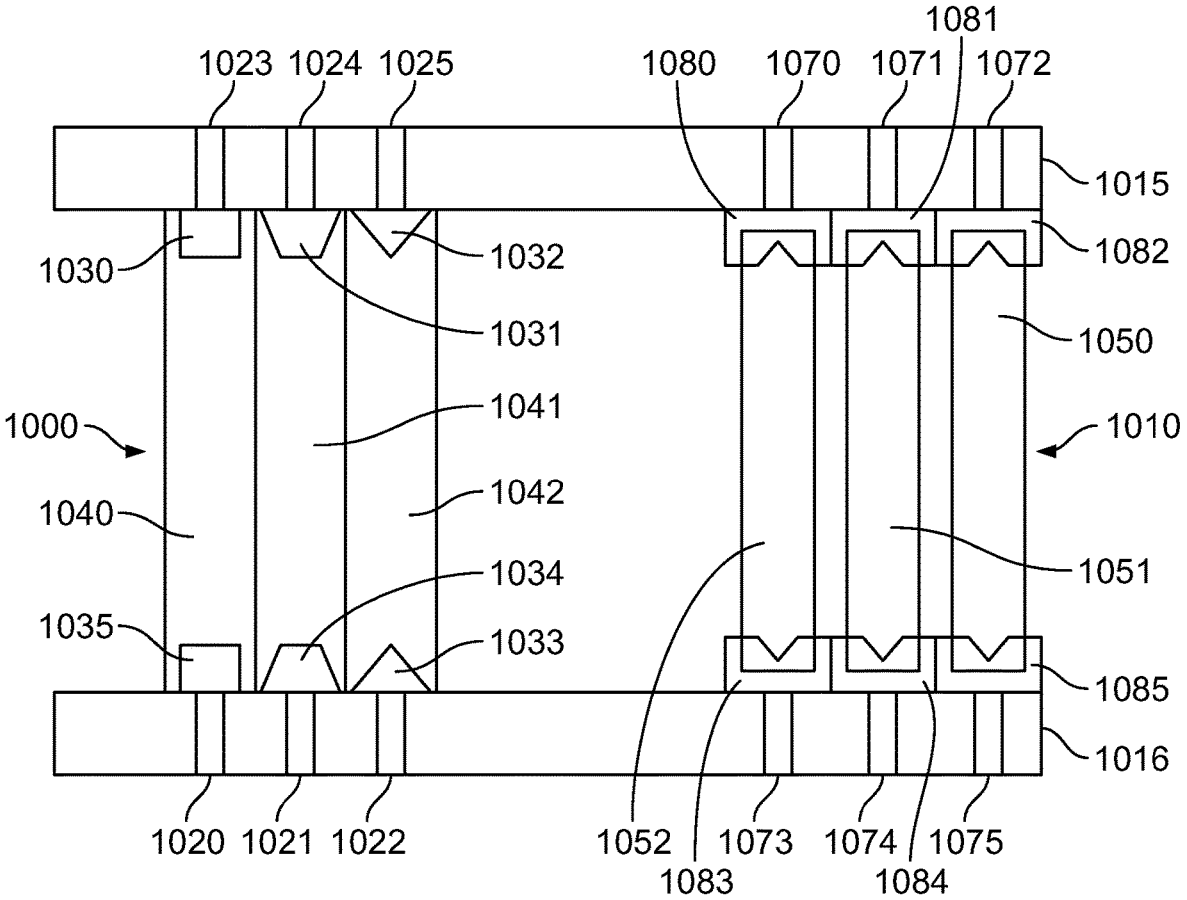
FIG. 10 illustrates a wall system provided by an embodiment of the present invention.

FIG. 10 depicts a wall system provided by an embodiment of the present invention. As shown, panel 1000 may be made of one or more bamboo segments 1040-1042 which are secured to support beams 1015-1016 by panel clamps 1020-1025. Panel clamps 1020-1025 may include plugs 1030-1035 that are configured to form a friction fit with the inside of a bamboo segment. Since the interior portions of the bamboo segments are not uniform, the plugs may be tapered or conical in shape to form a strong friction fit. In addition, the plugs may be made of a resilient, yet deformable material such as rubber to promote the friction fit. Alternately, a wall panel such as panel 1010 may be made from one or more segments 1050-1052. Segments 1050-1052 may be secured to structural supports 1015-1016 by panel clamps 1070-1075, which include connector segments 1080-1085 of the design and construction described. The connectors secure a bamboo segment by a friction fit and/or hoop-compression as described above.

Figure 11A:
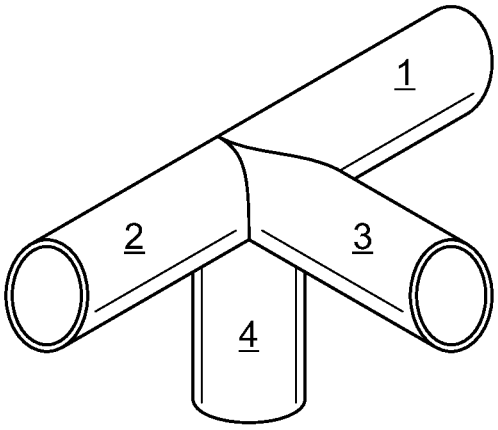
FIG. 11A illustrates a connector for use with three beams and one column provided by an embodiment of the present invention.
Figure 11B:
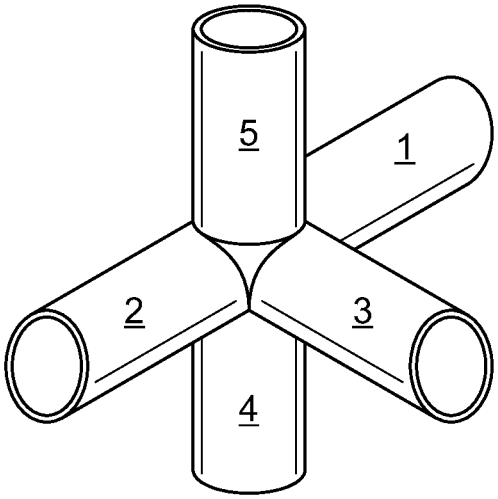
FIG. 11B illustrates a connector for use with three beams and two columns provided by an embodiment of the present invention.

FIG. 11A illustrates a connector for use with three beams and one column provided by an embodiment of the present invention. FIG. 11B illustrates a connector for use with three beams and two columns provided by an embodiment of the present invention.

The present invention provides many benefits over the prior art, including, but not limited to: low manufacturing cost and low labor costs, as well as no precision is required in the connection hardware since the present invention may accommodate segments or poles having variable diameters; significant moment-resisting cross-sections at all joints is provided by clamps made from a rigid material such as light gauge steel or epoxy material as well as all materials known to those of skill in; a plurality of diameter bamboo poles intersection at any joint in a structure; does not penetrate the bamboo cross-section in any way; requires no bolts, screws, nails, or other attachment devices; and does not involve glues that are applied with high-heat to the bamboo cross-section or the bamboo material.

In an alternate embodiment, the present invention may be used to create structures from other natural building materials that do not have uniform dimensions. These materials include but are not limited to logs and planks obtained from trees.

In an alternate embodiment, the present invention provides connectors for connecting bamboo poles and/or other non-uniform materials to standard building materials such as standard wall, floor, and ceiling panels. This allows buildings and materials not constructed of bamboo to connect to the network of connected load supporting or loadbearing bamboo poles. This alternate embodiment of the present invention allows standard-design (wood, wallboard, aluminum, etc.) panels for walls, floors, and ceilings without alterations to be connected to or used on a frame consisting of bamboo beams and columns. This alternate embodiment provides benefits over prior art, specifically, but not limited to: no penetrations in the bamboo because of nails, screws, bolts, or other attachment mechanisms are required; accounts for the non-uniform cylindrical properties of the bamboo poles; and uses hoop-compression and friction as the physical mechanisms for the connections.

In yet other embodiments, the location of the slots in the bamboo pole connectors may be aligned along the neutral axis of the cross-section over which the bending stresses are minimal. On beams, under the influence of vertical loads this is the horizontal axis (on a clock at position 3 o'clock and 9 o'clock). For columns, which tend to be loaded in two directions (due to wind or earthquake loads), the connector slots would still be on the neutral axis which has the smallest bending stresses, but adjacent columns in the building could have their connector slots oriented along the perpendicular axis (at positions of 6 o'clock and 12 o'clock), where each column along a row of columns would have the connector slots placed along different neutral axes in an alternating manner to give rigidity to the whole structure in each of the two directions. In yet other embodiments, the connectors may be configured to aid in locating the slots along different neutral axes. For example, in some connectors, the slots may be located at various locations or positions around the connector, e.g., 6 o'clock and 12 o'clock and 3 o'clock and 9 o'clock. This staggering or alternating the location of the slots may be employed in the elbow, T-shaped and other connectors described herein. In other words, for sets of the same connectors, the locations or positions of the slots in a set of connectors are staggered around the opening of the connector.

While the foregoing written description enables one of ordinary skill to make and use what is considered presently to be the best mode thereof, those of ordinary skill will understand and appreciate the existence of variations, combinations, and equivalents of the specific embodiment, method, and examples herein. The disclosure should therefore not be limited by the above described embodiments, methods, and examples, but by all embodiments and methods within the scope and spirit of the disclosure.

What is claimed is:

1. A construction system for creating a moment-resisting joint between two or more building material segments having non-uniform diameters, the construction system comprising:

a connector comprising a body comprising at least two connector segments, each of said connector segments comprising an opening having a diameter capable of receiving a building material segment, said connector segment comprising at least one channel extending along the primary axis of said connector segment from a first end at or near said opening to a second end opposite said first end, wherein at least one of said at least one channel comprises a scalloped section at said second end;

at least one compression clamp capable of forming a friction fit between at least one of said at least two connector segments and the building material segment;

wherein said connector is capable of creating a moment-resisting joint joining at least two building material segments having non-uniform diameters disposed within at least two of said at least two connector segments to at least a distance such that the at least two building material segments are wedged in place by said friction fit and such that a moment-resisting joint is formed.

2. The construction system of claim 1 further comprising: a first and a second building material segment each having a non-uniform diameter and each having a first end, wherein the first and second building material segments are disposed within said openings of said at least two connector segments, said first end of each of the first and second building material segments disposed within said at least two connector segments a distance such that said first and second building material segments are wedged in place by said friction fit and form a moment-resisting joint with said connector.

3. The construction system of claim 2 wherein said first and a second building material segments comprise bamboo.

4. The construction system of claim 2 wherein said first and a second building material segments comprise a natural building material.

5. The construction system of claim 1 wherein said body includes a rigid portion located between said connector segments, and wherein said connector segments are collinear.

6. The construction system of claim 1 wherein one or more of said openings have different diameters.

7. The construction system of claim 1 wherein said body positions said connector segments into an elbow connector.

8. The construction system of claim 1 wherein said body is T-shaped.

9. The construction system of claim 1 wherein said body comprises six connector segments.

10. The construction system of claim 9 wherein said six connector segments are located at 90-degrees to one another.

11. The construction system of claim 10 wherein at least one of said six connector segments has a larger opening than the other segments.

12. The construction system of claim 1 wherein said at least one compression clamp comprises a plurality of panel clamps.

13. The construction system of claim 12 wherein said panel clamps include a plug sized to fit within a building material segment.

14. The construction system of claim 13 wherein said plugs are tapered or conical.

15. The construction system of claim 14 wherein said plugs are made of a deformable material.

16. The construction system of claim 1 further including a foundation anchor, said foundation anchor including a body and a connector segment.

17. The construction system of claim 1 further comprising:

a plurality of foundation anchors, each of said foundation anchors comprising a sleeve and an expansion and compression slot defining an opening, said opening adapted to receive the building material segment;

a clamp for compressing said sleeve against said building material segment; and a plurality of anchor holders adapted to receive a reinforcing rod.

* * * * *